US005118094A

United States Patent [19]

Lambert

[11] Patent Number: 5,118,094

[45] Date of Patent: Jun. 2, 1992

[54] ROTARY AMUSEMENT DEVICE WITH RATCHETABLE HANDLE

[75] Inventor: Gregory F. Lambert, E. Aurora, N.Y.

[73] Assignee: Today's Kids, Inc., Boonseville, Ark.

[21] Appl. No.: 650,148

[22] Filed: Feb. 4, 1991

[51] Int. Cl.[5] ..... A63G 1/10

[52] U.S. Cl. ..... 472/14

[58] Field of Search ..... 272/33 R, 33 A, 33 B, 272/39, 46, 43-45, 28 S, 28 R; 192/46; 188/82.8, 82.84, 82.9

[56] References Cited

U.S. PATENT DOCUMENTS

| | | | |
|---|---|---|---|
| 1,368,132 | 2/1921 | Gavcar | 272/33 R |
| 3,170,687 | 2/1965 | Lugger | 272/33 R |
| 3,612,518 | 10/1971 | Bennett | 272/33 R |
| 3,873,087 | 3/1975 | Burkant et al. | 272/33 R |
| 4,119,310 | 10/1978 | Trubudy | 272/33 R |
| 4,245,837 | 1/1981 | Menschel | 272/33 R |
| 4,896,877 | 1/1990 | Moomaw et al. | 272/33 R X |

*Primary Examiner*—Richard E. Chilcot, Jr.
*Attorney, Agent, or Firm*—Kirkpatrick & Lockhart

[57] ABSTRACT

A rotary amusement device for supporting a child and enabling him to propel himself in a circular path about a vertical axis. The device includes a seat member which is rotatably supported on a base member for rotation about an upstanding vertical post member. A first ratchet gear is non-rotatably attached to the post member. A hollow sleeve member is positioned completely around the post member and houses a second ratchet gear in a slideable non-rotational manner to thereby facilitate ratchetable engagement with the first ratchet gear. A grippable handle member is attached to the sleeve member for effectuating a ratcheting motion of the sleeve member around the upstanding post member.

16 Claims, 10 Drawing Sheets

ROTARY AMUSEMENT DEVICE WITH RATCHETABLE HANDLE

BACKGROUND OF THE INVENTION

1. Field of the Invention

The present invention relates to children's amusement devices and, in particular, to a device for supporting a child in a rotational path around a vertical axis.

2. Description of the Invention is Background

Perhaps some of the fondest memories of most people's childhood experiences are the times when they visited a local amusement park or playground. It is usually during these trips that a child's fascination with rotary amusement rides first begins. Such devices may range from the typical carnival carrousel having riding horses mounted thereon to various types of playground equipment and toys such as those riding devices disclosed in U.S. Pat. Nos. 1,368,132; 1,839,509; 2,018,655; and 4,286,781.

In today's busy world, however, parents, opportunities to take their children to the amusement park or local playground are often limited by various time constraints. As such, there is a need for portable amusement devices that may be safely operated in the child's home. However, the devices of the above-cited patents are not adapted for in home use due to their bulky construction.

The rotary amusement devices of the type disclosed in U.S. Pat. Nos. 2,785,896; 3,170,687; and 3,873,087, however, are portable and capable of being operated in the child's home. In all of these devices, the child is propelled on a rotating platform around a vertical post by grasping a circular handle that is affixed to the post. As the platform rotates, the child'grasp must be constantly changed to compensate for the every changing angular position of the platform relative to the vertical post. The rotational speed of the device is thus limited by how fast the child can move his or her hands around the handle member. Such hand movement is awkward and places a considerable amount of stress on the child'-wrists.

This problem was addressed by the device disclosed in U.S. Pat. No. 1,368,132 wherein a ratchet gear is mounted to the vertical post and is engaged by a spring loaded pawl that is attached to a handle member. By rotating the handle member, the rider may ratchet the platform around the post. However, while attempting to address the problem discussed above, a greater safety problem was created because the gear/pawl arrangement is totally exposed. In particular, a child may easily get a finger or article of clothing caught in the ratchet mechanism as the platform rotates around the post.

The subject invention is directed toward an improved design for rotary amusement devices which overcomes, among others, the above-discussed problems and which provides for a safer and more enjoyable ride.

SUMMARY OF THE INVENTION

In accordance with the present invention, there is provided an improved design for an occupant propelled rotary amusement device. The amusement device provided includes a circular base member having an upwardly projecting circular receptacle at its center. A circular seat member having an opening at its center is positioned over the base so that the circular receptacle projects through the opening. The seat member is supported relative to the base member on a series of ball bearings so that it may freely rotate about the circular receptacle. A vertically aligned post is non-rotatably connected to the base member by inserting one of its ends into the circular receptacle on the base member and fastening it thereto. A hollow sleeve member is coaxially positioned over the post for rotation therearound. A first ratchet gear is non-rotatably attached to the post and is adapted to engage a second ratchet gear that is slidably and non-rotatably received within the hollow sleeve member. A grippable handle is rigidly attached to the hollow sleeve member to enable the rider to ratchet the handle and sleeve around the post so as to effectuate relative movement of the seat with respect to the base.

In another embodiment of the present invention, the second ratchet gear is spring biased into engagement with the first ratchet gear.

Accordingly, the present invention provides solutions to the aforementioned problems encountered when using prior rotary amusement devices. Because this invention provides a ratchet mechanism that is fully enclosed within a sleeve member, the rider may safely operate the device by gripping the handle member with one hand. These and other details, objects and advantages of the invention will become apparent as the following Detailed Description Of The Preferred Embodiment thereof proceeds.

BRIEF DESCRIPTION OF THE DRAWINGS

In the accompanying drawings, I have shown a present preferred embodiment of the invention, for purposes of illustration only, wherein.

DETAILED DESCRIPTION OF THE PREFERRED EMBODIMENT

Figure 1:
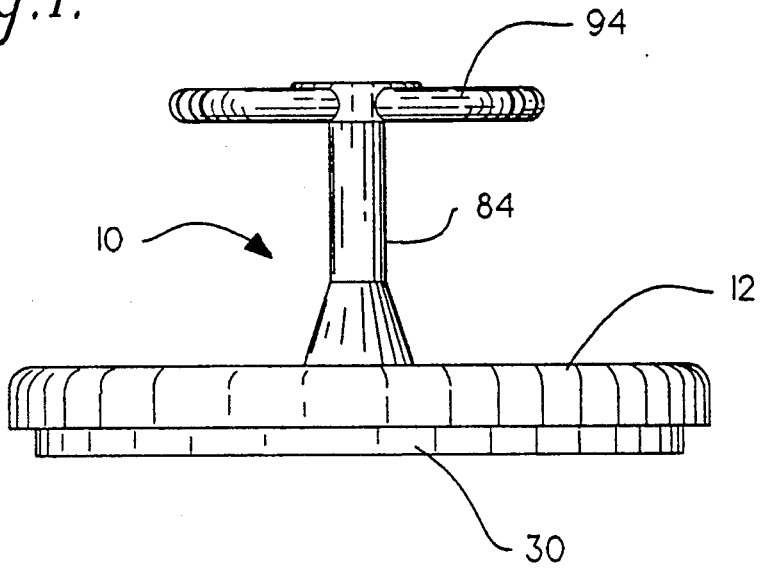
FIG. 1 is a front elevational view of the rotary amusement device of the present invention.

Referring now to the drawings which are for purposes of illustrating the present preferred embodiment of the invention only and not for the purposes of limiting the same, the Figures show an occupant propelled rotary amusement device, generally designated as 10, constructed according to the teachings of the present invention.

Figure 2:
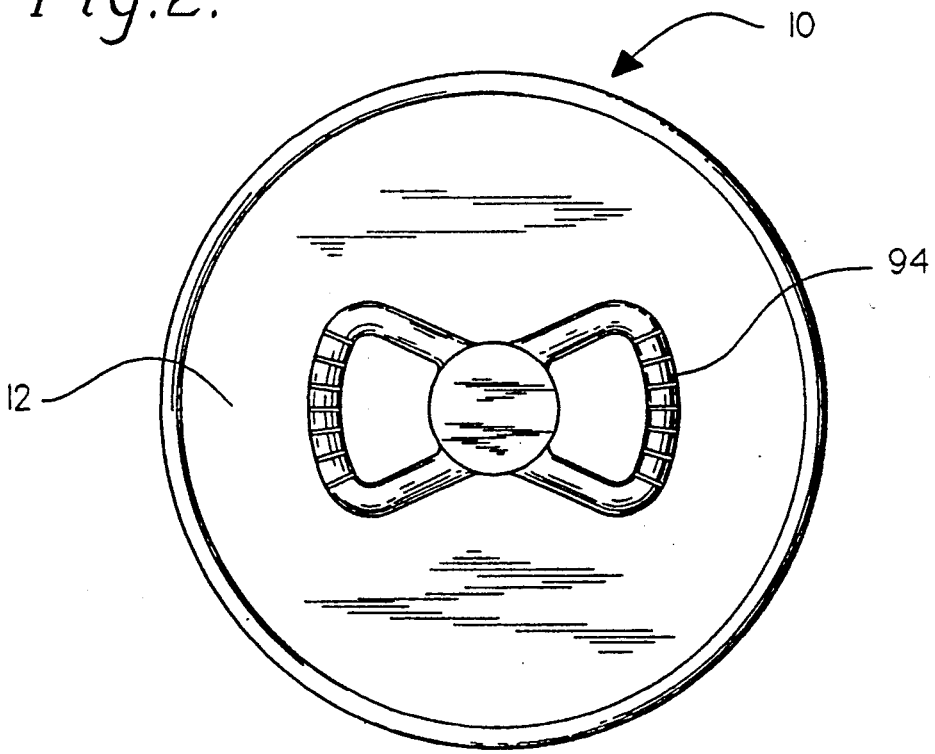
FIG. 2 is a top view of the rotary amusement device of the present invention.
Figure 3:
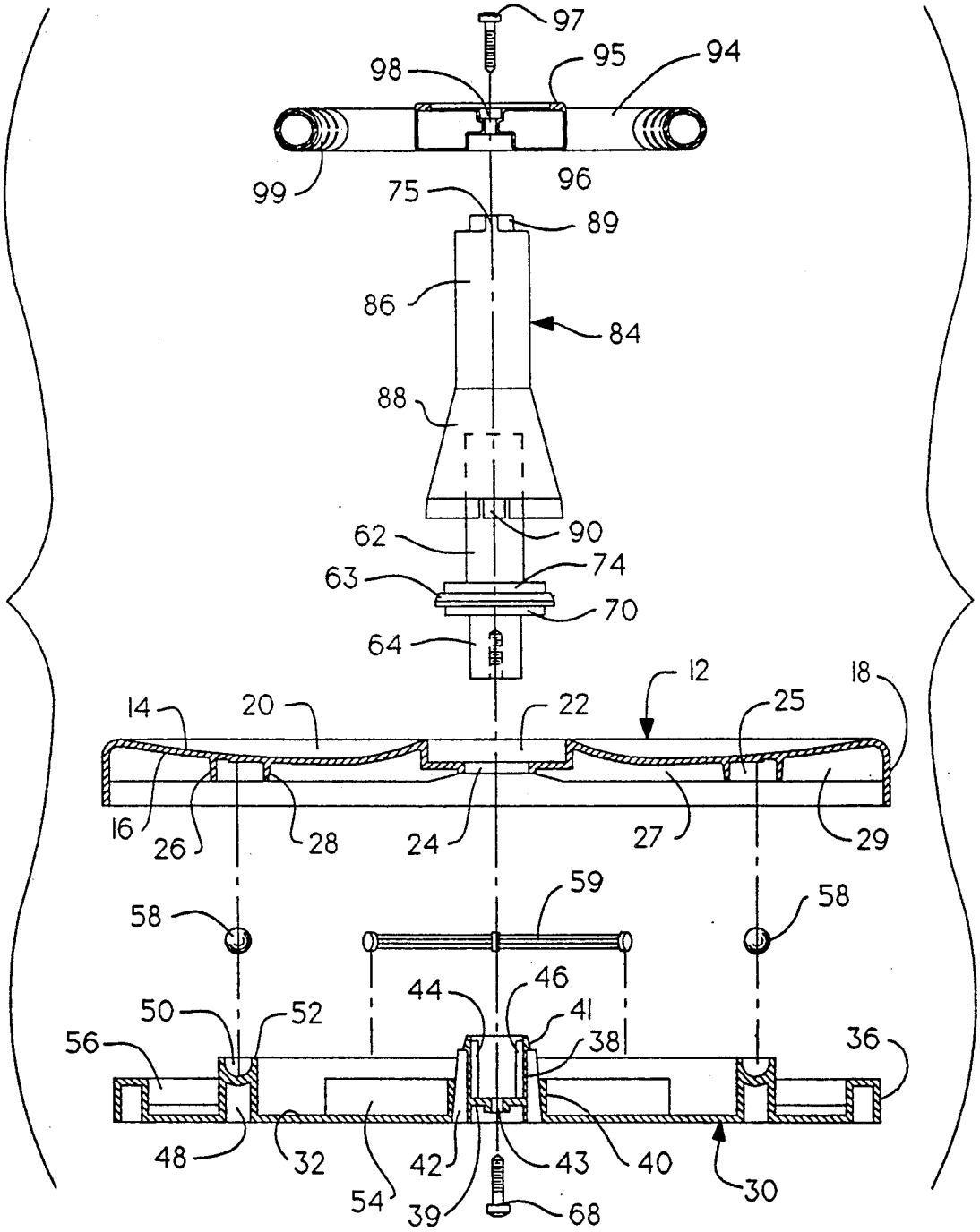
FIG. 3 is an exploded assembly view of the present invention depicting some elements in cross section.

More particularly, and with reference to FIGS. 1, 2, and 3 there is shown a circular seat member 12 that is rotatably received on a circular base member 30. A grippable handle 94 is attached to a hollow sleeve member 84 which enables the rider to effectuate a ratchet-like motion with respect to base member 30.

Figure 4:
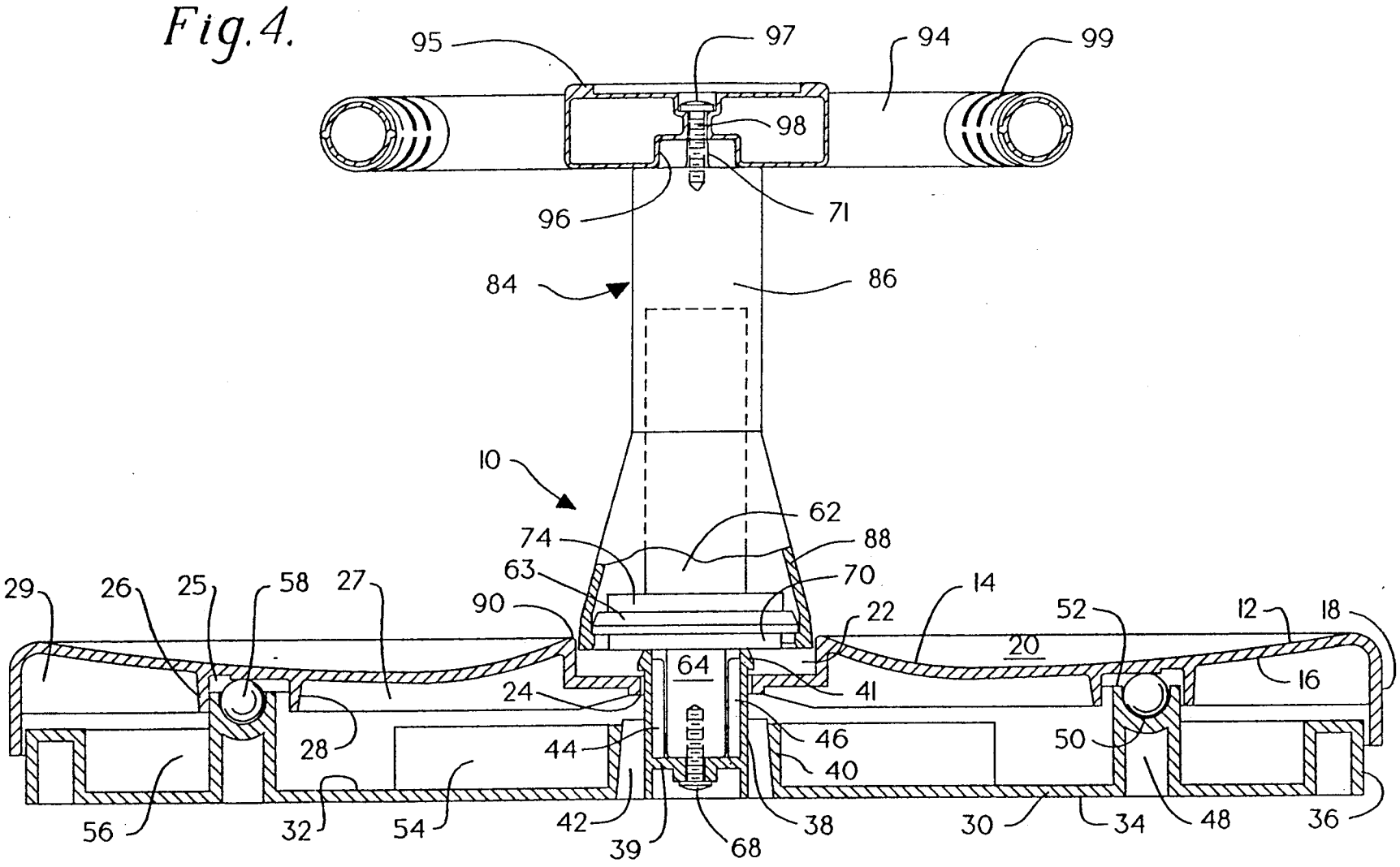
FIG. 4 is an elevational view and partial sectional view of the rotary amusement device of the present invention.
Figure 6:
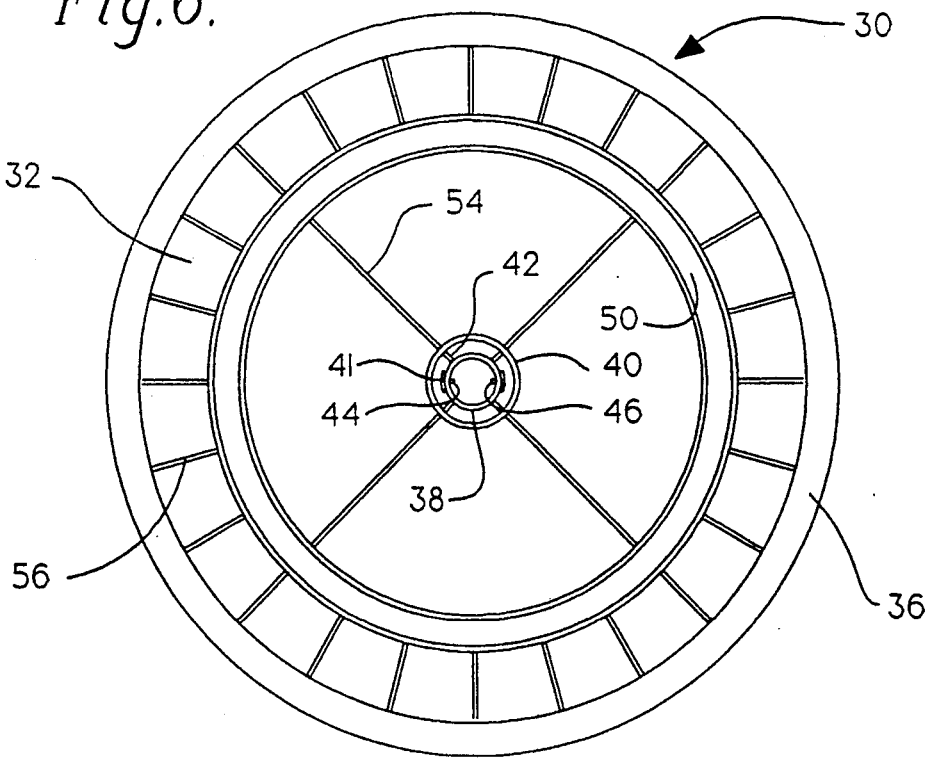
FIG. 6 is a top view of the base member of the present invention.

More specifically, as shown in FIGS. 3, 4, and 6, circular base 30 has an upper surface 32, a lower surface 34, and an upstanding flange 36 around its periphery. A circular receptacle 38 projects upwardly from the center of upper surface 32. In the preferred embodiment, a reinforcing socket 40 is concentrically positioned around receptacle 38 on upper surface 32 of base member 30. A plurality of webs 42 extend between receptacle 38 and reinforcing socket 40 to provide receptacle 38 with lateral support. As can be seen in the figures, receptacle 38 has a bottom surface 39 therein and is further provided with splines 44 and 46 which extend along its longitudinal axis.

As further shown in FIGS. 3, 4, and 6, an annular wall 48 projects upwardly from upper surface 32 of base member 30 at a distance slightly greater than halfway between reinforcing socket 40 and upstanding flange 36 as measured from reinforcing socket 40. Wall 48 is provided with a groove or raceway 50 along its top edge 52 for receiving a plurality of ball bearings 58. The raceway 50 defines a prescribed orbit for the plurality of ball bearings 58. In the preferred embodiment, wall 48 is laterally supported by a plurality of webs 54 that extend therefrom to connect it to reinforcing socket 40. Lateral support is also preferably provided to upstanding flange 36 by a plurality of webs 56 that extend between upstanding flange 36 and annular wall 48.

As shown in FIGS. 3 and 4 circular seat member 12 has an upper surface 14, a lower surface 16 (see FIG. 5), and a downwardly projecting side wall 18 at its periphery. Seat member 12 is larger in diameter than base member 30 to thereby enable wall 18 to overlap upstanding flange 36. In the preferred embodiment, a gradually sloping, shallow annular recess 20 is formed in upper surface 14 of seat member 12 between its periphery and an annular recess 22 concentrically located at its center.

Figure 5:
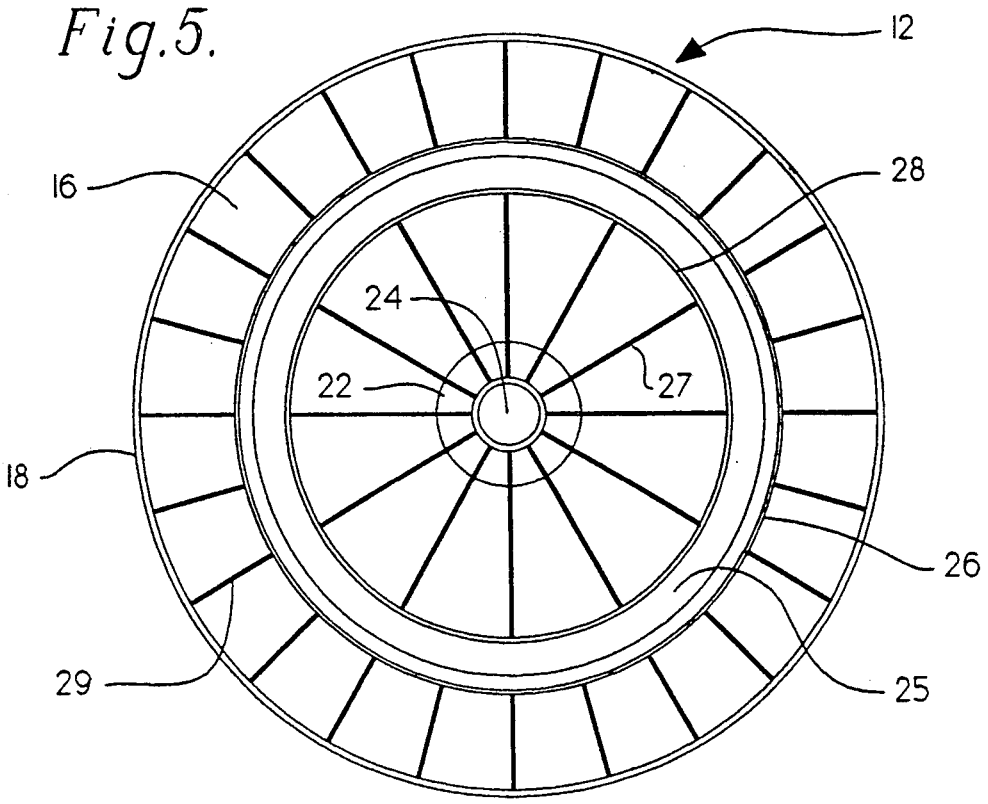
FIG. 5 is a bottom view of the seat member of the present invention.

As can be seen in FIGS. 3 and 5, a bore 24, having a diameter that is slightly greater than the diameter of receptacle 38, is provided through the center of recess 22. Seat member 12 is positioned on base member 30 so that receptacle 38 projects through bore 24 and into recess 22. A plurality of retaining tabs 41 extend outwardly from the top periphery of receptacle 38 into annular recess 22 to thereby prevent substantial vertical displacement of seat member 12 relative to base member 30 while permitting seat member 12 to freely rotate therearound. In the preferred embodiment, tabs 41 are molded into receptacle 38 which consists of polypropylene material. The resiliency of the polypropylene material enables tabs 41 to be snapped into recess 22 to complete the connection process. One of ordinary skill in the art, however, will recognize that receptacle 38 and tabs 41 can be fabricated out of any material having similar resilient characteristics.

An annular channel 25, as shown in FIGS. 3, 4, and 5, consisting of two downwardly projecting wall members 26 and 28, extends downwardly from lower surface 16 of seat member 12. Channel 25 cooperates with raceway 50 when seat member 12 is received on receptacle 38, to retain ball bearings 58 within raceway 50. In the preferred embodiment, annular channel 25 is laterally supported by a plurality of first webs 27 that extend between downwardly projecting channel wall 26 and annular recess 22. Additional lateral support is also preferably provided by a plurality of second webs 29 that extend between downwardly projecting channel wall 28 and downwardly projecting side wall 18.

Figure 21:
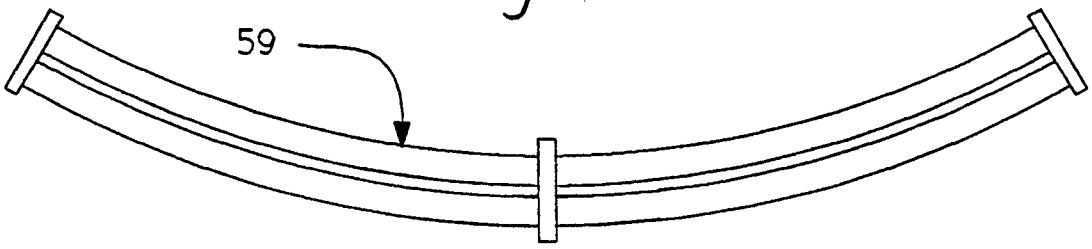
FIG. 21 is a top view of an acruate spacer of the present invention.

A plurality of arcuate spacers 59, (see FIGS. 3 and 21) are positioned between ball bearings 58 for slidably traveling in raceway 50 with ball bearings 58. The use of arcuate spacers 59 reduces the number of ball bearings needed, with at least five ball bearings 58 and five arcuate spacers 59 preferably being used in an alternating arrangement. The spacer 59 also keep the spacing between ball bearings 58 correct so that seat member 12 is uniformly supported.

Figure 9:
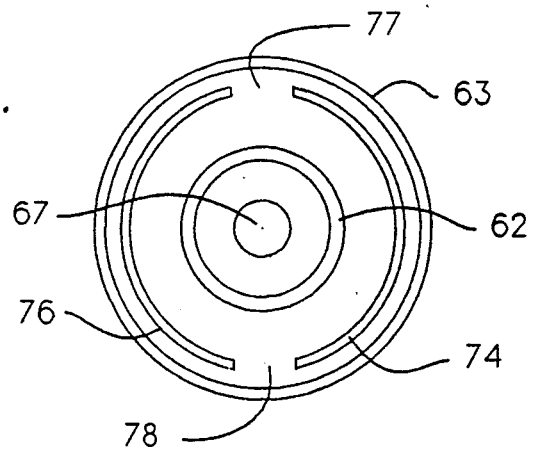
FIG. 9 is a top view of the post member of the present invention.
Figure 7:
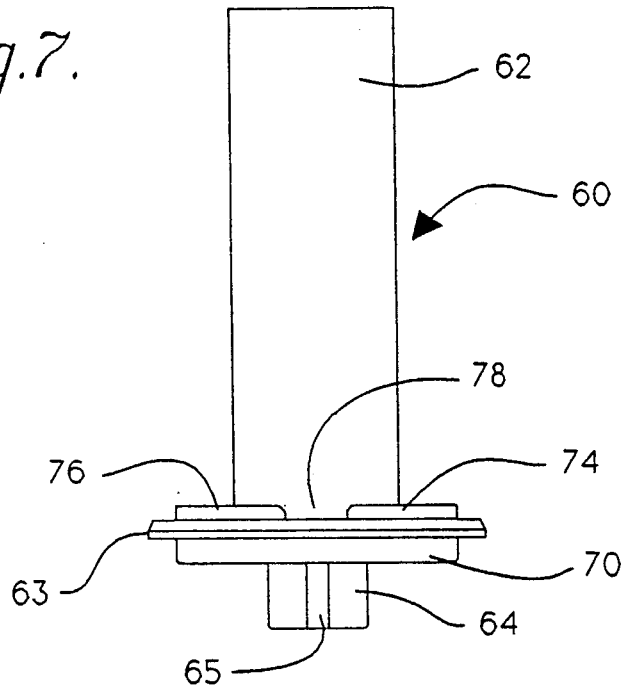
FIG. 7 is a side view of the post member of the present invention.
Figure 8:
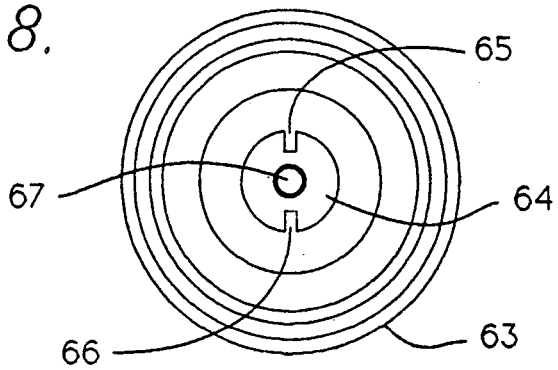
FIG. 8 is a bottom view of the post member of the present invention.
Figure 12:
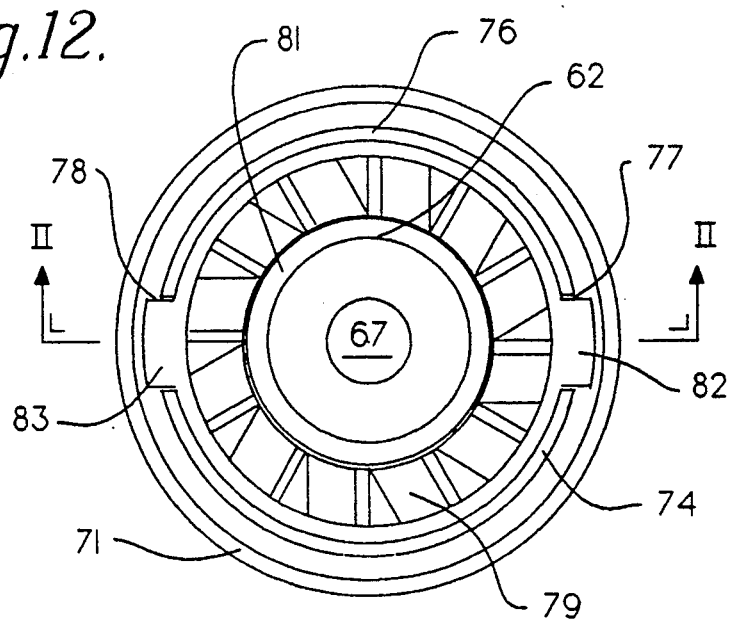
FIG. 12 is a top assembly view of the first ratchet gear of FIG. 10 and the post member of FIGS. 7, 8, and 9.
Figure 13:
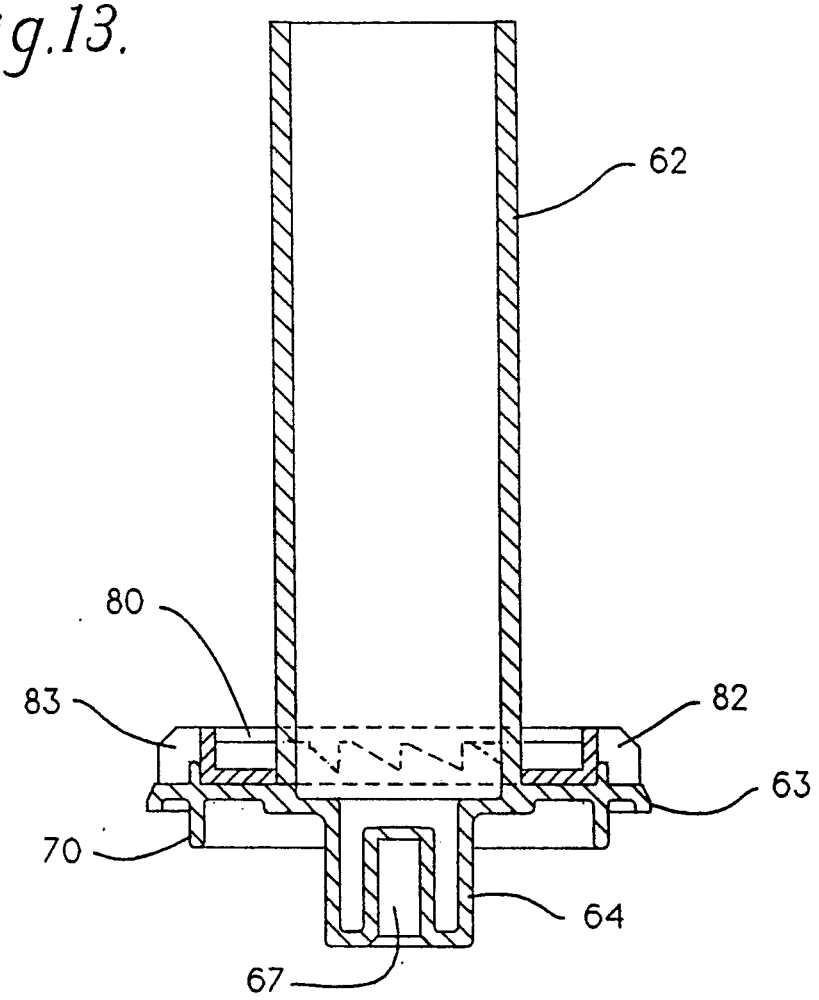
FIG. 13 is a sectional view of the assembly of FIG. 12 taken along II—II.

An upstanding vertical post 60, seen in FIGS. 7, 8, and 9, is preferably formed as a single unit and, has an upper portion 62, a lower portion 64, and a collar portion 70 that is situated between upper portion 62 and lower portion 64 along its vertical axis. Upper portion 62 has a general circular cross section and, in the preferred embodiment, takes the form of a hollow circular polypropylene tube. However, one of ordinary skill in the art will recognize that upper portion 62 could also be fabricated out of any similar machinable material and may also be solid throughout as opposed to being hollow.

Lower portion 64 has a circular cross section and is preferably formed out of a solid polypropylene rod. Lower portion 64 is smaller in diameter than the inner diameter of receptacle 38 to thereby enable lower portion 64 to be slidably received therein. Lower portion 64 further has two longitudinally extending grooves 65 and 66 formed therein for receiving splines 44 and 46 of circular receptacle 38. Such an arrangement prevents rotational movement of post 60 within receptacle 38. Lower portion 64 has a tapped hole 67 axially provided therein for threadably receiving a screw 68 that extends through a bore 43 located in bottom 39 of receptacle 38. Therefore, in the preferred embodiment, post 60 may be easily removed from receptacle 38 by removing screw 68.

Collar member 70 is coaxially located on post member 60 and serves to separate upper portion 62 and lower portion 64. Collar member 70 is greater in diameter than both upper portion 62 and lower portion 64 and, as shown in FIGS. 7 and 9, has two upstanding arcuate members 74 and 76 which are spaced to create an annular cavity 76. Arcuate members 74 and 76 do not completely encircle upper portion 62 thereby providing two small arcuate openings 77 and 78 therebetween. The outer periphery of collar member 70 carries a tapered shoulder member 63 for purposes to be explained hereinbelow.

As illustrated in FIGS. 10, 11, 12, and 13, a first ratchet gear 80 has an outer diameter that is slightly smaller than the inner diameter of annular cavity 76 and a bore 81 through its center. The bore 81 has a sufficient diameter so as to permit upper portion 62 to project therethrough. The first ratchet gear 80 is slidably received in circular cavity 76. Splines 82 and 83 extend outwardly from the periphery of first ratchet gear 80 and are respectively received in openings 77 and 78 between arcuate members 72 and 74 to thereby non-rotatably retain first ratchet gear 80 within circular cavity 76. First ratchet gear 80 has a plurality of angularly disposed gear teeth 79 that project upwardly when first ratchet gear 80 is seated within annular cavity 76. First ratchet gear 80 may be easily replaced by lifting it out of circular cavity 76 and sliding it off upper portion 62 of post 60.

Figure 16:
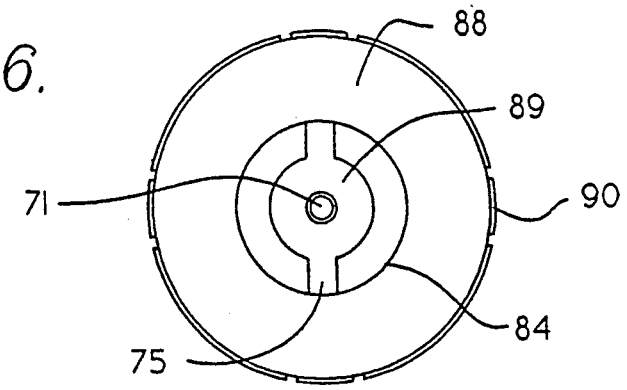
FIG. 16 is a top view of the sleeve member of the present invention.
Figure 14:
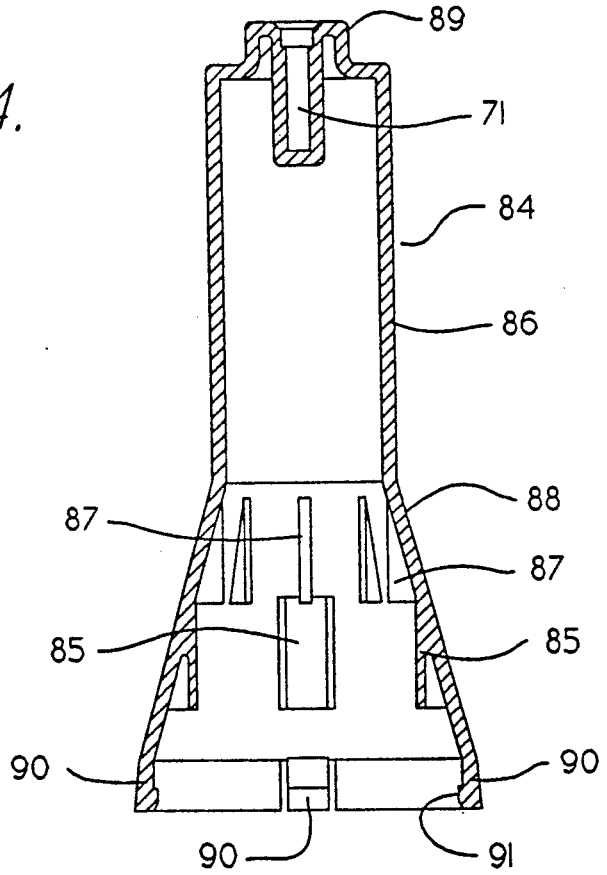
FIG. 14 is a sectional view of the sleeve member of the present invention.
Figure 15:
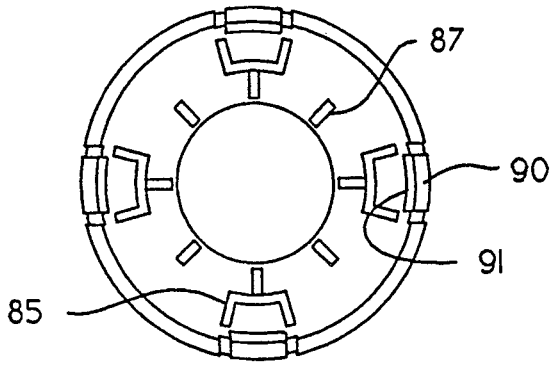
FIG. 15 is a bottom view of the sleeve member of the present invention.

As illustrated in FIGS. 14, 15, and 16, the hollow sleeve member 84 has a cylindrical upper portion 86 and a conical lower portion 88. Conical lower portion 88 is adapted to rotate around the tapered and shoulder member 63 of collar 70. In the preferred embodiment, hollow sleeve member 84 is made out of resilient polypropylene material and has a plurality of tabs 90 cut into the lower periphery of conical portion 88. Each tab 90 has an inwardly extending lip portion 91 molded thereto. The diameter between lip portions 91 is less than the diameter of shoulder member 63 to thereby enable tabs 90 to be snapped over shoulder member 63 to thus prevent the substantial vertical displacement of sleeve member 84 with respect to post member 60. In addition, cylindrical upper portion 86 of sleeve member 84 has an inner diameter that is slightly greater than the outer diameter of upper post portion 62 to thereby enable upper post portion 62 to extend therein to provide sleeve member 84 with greater vertical stability.

Figure 17:
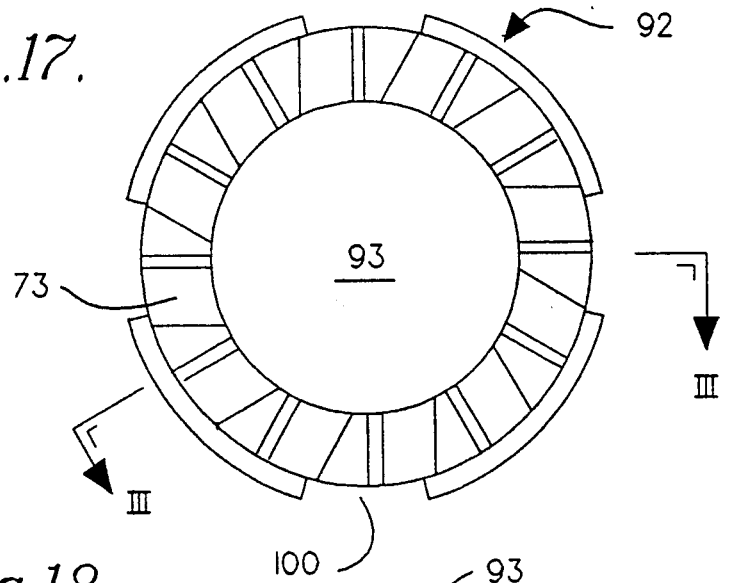
FIG. 17 is a top view of the second ratchet gear of the present invention.
Figure 18:
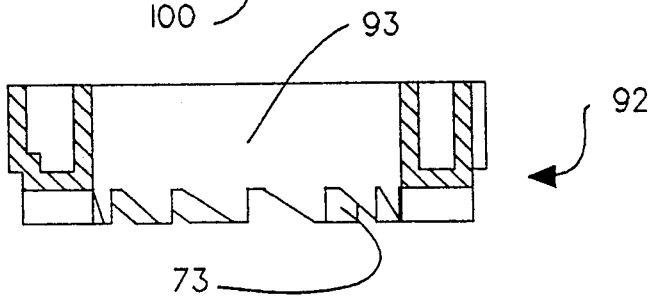
FIG. 18 is a sectional view of the second ratchet gear of FIG. 17 taken along III—III.
Figure 10:
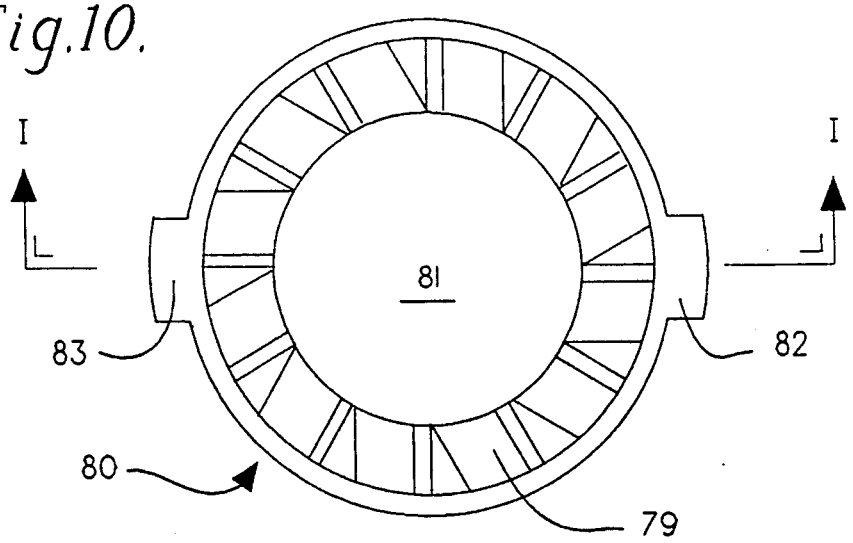
FIG. 10 is a top view of the first ratchet gear of the present invention.
Figure 11:
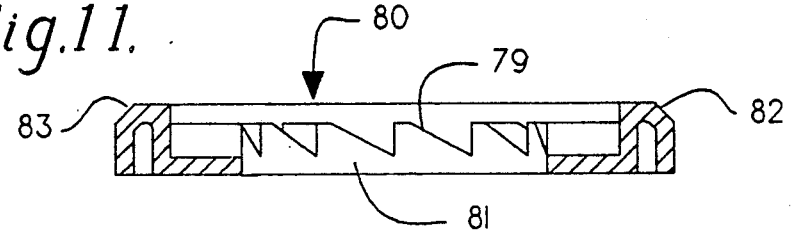
FIG. 11 is a section view of the first ratchet gear of FIG. 10 taken along I—I.

As can bee seen in FIGS. 17 and 18, a second ratchet gear 92 has a bore 93 through its center of sufficient diameter so as to permit upper portion 62 of post 60 to project therethrough. Ratchet gear 92 is slidably received on upper portion 62 for ratchetable engagement with first ratchet gear 80. A plurality of grooves 100 extend outwardly from the periphery of second ratchet gear 92 and are slidably received within a plurality of corresponding first splines 85 extending longitudinally within conical lower portion 88 of hollow sleeve member 84.

Figure 19:
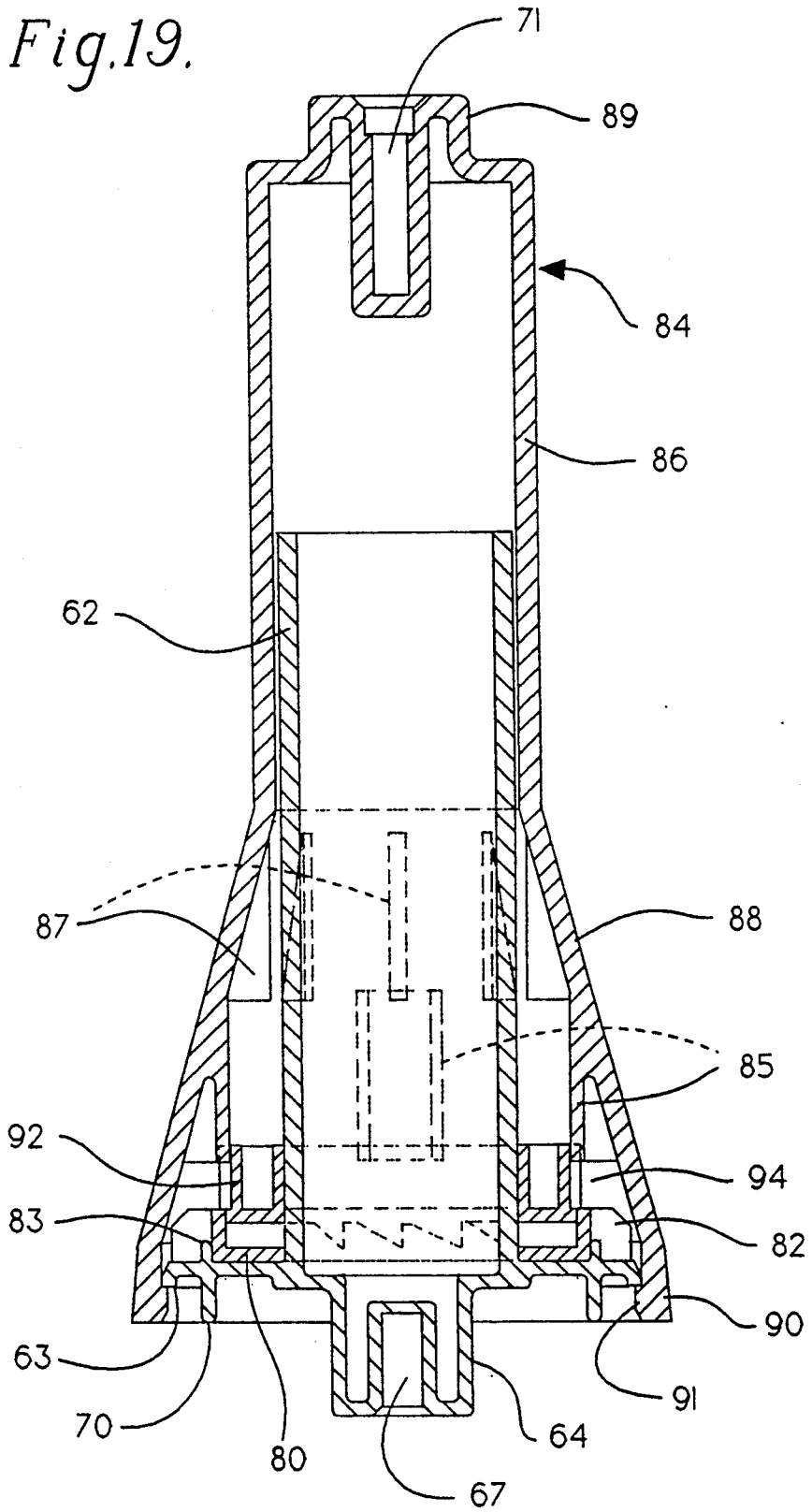
FIG. 19 is a sectional view of the assembly of the post member, first ratchet gear, second ratchet gear, and the sleeve member of the present invention.

As seen in FIGS. 17 and 18, second ratchet gear 92 has a plurality of angularly disposed teeth 73 therein adapted to engage and disengage teeth 79 of first ratchet gear 80 as second ratchet gear 92 is ratcheted around post member 60. By reversing the direction of rotation, second ratchet gear 92 disengages from first ratchet gear 80 and slides upward in conical lower portion 88. The upward travel of second ratchet gear 92 within conical lower portion 88 is limited by a plurality of second splines 87 longitudinally positioned within the upper end of conical lower portion 88. The combination of post 60, hollow sleeve member 84, first ratchet gear 80, and second ratchet gear 92 is illustrated in FIG. 19.

Figure 20:
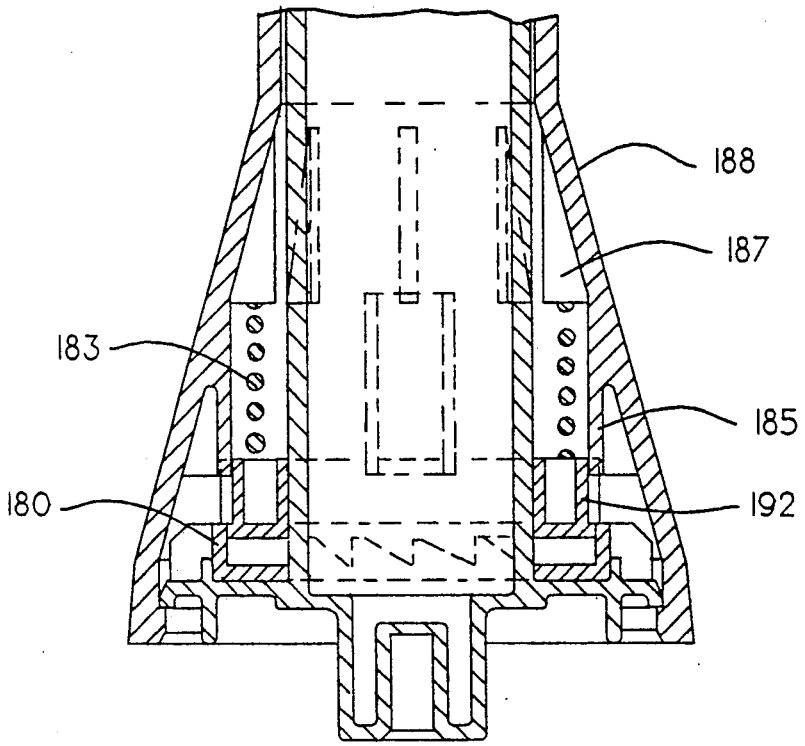
FIG. 20 is a sectional view of an alternate embodiment of the present invention.

In a second embodiment of the present invention, as shown in FIG. 20, second ratchet gear 192 is biased onto first ratchet gear 180 by compression spring 183. In this embodiment, compression spring 183 extends between second splines 187 and second ratchet gear 192 to cause second ratchet gear to positively engage first ratchet gear 180.

Referring now to FIGS. 3 and 4, a handle member 94 having a center portion 95 therein, is non-rotatably fastened to upper portion 86 of sleeve member 84. In the preferred embodiment, handle member 94 takes the form of a slightly modified figure eight having a circular shaped center 95. In addition, a plurality of ribs 99 are provided on the handle member 94 to assist the rider in gripping the handle. However, one of ordinary skill in the art will recognize that handle member 94 may take on a myriad of other shapes that are adapted to be gripped by a rider.

As shown in FIGS. 3 and 4, center portion 95 of handle 94 has a cavity 96 therein adapted to receive a raised portion 89 located on the top of upper portion 86 of sleeve member 84. In the preferred embodiment, raised portion 86 additionally has two outwardly extending splines 75 that are received within center portion 95 to prevent the rotation of handle member 94 with respect to sleeve member 84. Handle member 94 is removably attached to sleeve member 84 by a screw 97 that extends through a bore 98 located in center portion 95 to be threadedly received in a threaded cavity 71 located in upper portion 86 of sleeve member 84.

The operation of the amusement device is relatively simple. A child positions himself on seat member 12 by sitting on the seat with sleeve member 84 between his legs. By exerting an alternating pulling and pushing force against the handle 94, sleeve member 84 is ratcheted around post member 60 This ratcheting action causes the seat 12 to rotate relative to the post 60 and base member 30. Due to this ratcheting effect, a child can easily operate and adjust the rotational speed of the device by gripping the handle with one hand.

What is claimed is:

1. A rotary amusement device, comprising:

a circular base member having an upper surface;

an upwardly extending circular post member having a lower portion, said lower portion being detachably and non-rotatably fixed to the center of said circular base member;

a circular seat member having an opening at its center sized to receive said post member;

means for rotationally supporting said seat member on said base member so that said post member projects through said opening in said seat member;

a first ratchet gear means detachably and non-rotatably fixed to said lower portion of said post member;

a hollow sleeve member concentrically positioned over said post member for rotation therearound;

a handle member removably attached to said upper portion of said sleeve member; and a second ratchet gear means longitudinally slidable and non-rotatably fixed within said hollow sleeve member for engagement with said first ratchet gear means whereby said handle member rotates in only one direction with respect to said base member.

2. A rotary amusement device as recited in claim 1 wherein said seat member has an upper and a lower surface, said means for rotationally supporting said seat member on said base member includes:

a plurality of ball bearings;

an annular raceway extending upwardly from said upper surface of said base member and defining a prescribed orbit for said plurality of ball bearings; and an annular channel extending downwardly from said lower surface of said seat member and cooperating with said annular raceway to retain said ball bearings within said raceway.

3. A rotary amusement devise as recited in claim 2 additionally comprising a plurality of arcuate spacers positioned between said ball bearings.

4. A rotary amusement device as recited in claim 2 wherein said base member includes retaining means for preventing substantial vertical displacement of said seat member relative to said base member.

5. A rotary amusement device as recited in claim 4 wherein said retaining means includes a circular receptacle extending upwardly from the center of said upper surface of said base member and substantially corresponding with said opening in said seat member so that said seat member may rotate therearound, said receptacle having at least one retaining tab extending therefrom adapted to engage an annular recessed area extending around said opening in said seat member to thereby prevent substantial vertical displacement of said seat member relative to said base member.

6. A rotary amusement device as recited in claim 5, wherein said lower portion of said post member is slidably received in said circular receptacle, said circular receptacle having at least one longitudinally extending spline therein, said spline substantially corresponding to at least one grooved recess in said lower portion of said post member to thereby deteachably and non-rotably fix said post member to said base member.

7. A rotary amusement device as recited in claim 6, additionally comprising a screw for fixing, said post member to said base member.

8. A rotary amusement device as recited in claim 6, wherein said post member, has an upper portion and further has a collar portion rigidly attached thereto between said upper and lower portions, said collar portion being adapted to non-rotatably receive said first ratchet gear means.

9. A rotary amusement device as recited in claim 8, wherein said first ratchet gear means has a plurality of splines extending outwardly therefrom, said splines being received in a plurality of corresponding openings in said collar portion to thereby prevent said first ratchet gear means from rotating therein.

10. A rotary amusement device as recited in claim 9, wherein said collar has a shoulder portion circumferentially extending therearound; and wherein said hollow sleeve member has a lower portion having a plurality of retaining members therein, said retaining members being adapted to snap over said shoulder portion of said collar to thereby prevent substantial vertical displacement of said sleeve member relative to said post member while permitting said sleeve member to be rotationally displaced around said shoulder member.

11. A rotary amusement device as recited in claim 10, wherein said lower portion of said hollow sleeve member is conical in shape.

12. A rotary amusement device as recited in claim 11, wherein said lower conical portion of said hollow sleeve member has at least two longitudinally extending splines therein, said splines substantially corresponding with an equal number of grooves in the perimeter of said second ratchet gear means for slidable engagement therewith to thereby enable said second ratchet gear means to non-rotatably slide on said splines during engagement and disengagement with said first ratchet gear means as said hollow sleeve member rotates around said post member.

13. A rotary amusement device as recited in claim 12 additionally comprising means for biasing said second ratchet gear means into engagement with said first ratchet gear means.

14. A rotary amusement device as recited in claim 13 wherein said biasing means includes a spring.

15. A rotary amusement device as recited in claim 14 wherein said circular seat member is larger in diameter than said circular base member and further has a downwardly projecting side wall along its periphery.

16. A rotary amusement device, comprising:

a circular base member having an upper surface and an annular raceway extending upwardly from said upper surface and defining an orbit for a plurality of ball bearings;

a plurality of ball bearings positioned within said raceway;

a circular receptacle extending upwardly from the center of said upper surface of said base member, said circular receptacle carrying two longitudinally extending splines and two outwardly extending tabs;

an upwardly extending circular post member having upper and lower portions, said lower portion having two longitudinal grooves therein substantially corresponding to said splines in said receptacle to thereby enable said lower portion of said post member to be slidably and non-rotatably received therein, said post member further including a collar portion and a raised shoulder portion perimetrically affixed thereto;

a first ratchet gear rigidly attached to said post member;

a circular seat member having a lower surface, said circular seat member being larger in diameter than said base member and having a downwardly extending wall from its periphery, said seat member having an opening at its center substantially corresponding with said receptacle for rotation therearound, said circular seat member being rotationally retained on said receptacle by said tabs extending outwardly therefrom, said seat member having an annular channel extending downwardly from its lower surface and cooperating with said annular raceway to retain said ball bearings within said raceway between said base member and said seat member to thereby rotationally support said seat member on said base member, said ball bearings being separated from one another by arcuate separator members adapted to slide within said defined orbit;

a hollow sleeve member concentrically positioned over said post member for rotation therearound, said sleeve member having a cylindrical upper portion and a conical lower portion, said conical portion having four equally spaced longitudinal splines therein and four retaining tabs affixed to its lower perimeter, said retaining tabs being adapted to snap over said raised shoulder portion of said post member to thereby prevent substantial vertical displacement of said sleeve member with respect to said post member while enabling said sleeve member to be rotationally displaced therearound;

a second ratchet gear means adapted for engagement with said first ratchet gear means and having an opening in the center thereof, said opening substantially corresponding with said upper portion of said post member to enable said second ratchet gear means to be slideably received on said upper portion of said post member, said second ratchet gear means having four grooves in its perimeter substantially corresponding with said splines in said conical portion of said hollow sleeve member to thereby enable said second ratchet gear means to non-rotatably slide on said splines to engage and disengage the first ratchet gear means as said hollow sleeve member is rotated about said base member; and a grippable handle member removably attached to the upper portion of said sleeve member for effectuating ratcheting movement of said sleeve member with respect to said post member.

* * * * *

UNITED STATES PATENT AND TRADEMARK OFFICE

CERTIFICATE OF CORRECTION

PATENT NO. : 5,118,094

DATED : June 2, 1992

INVENTOR(S) : Gregory F. Lambert

It is certified that error appears in the above-identified patent and that said Letters Patent is hereby corrected as shown below:

Col. 1, line 34, delete "child'grasp" and substitute therefore --child's grasp--.

Col. 1, line 40, delete "child" and substitute therefore --child's--.

Signed and Sealed this

Thirtieth Day of November, 1993

*Attest:*

*Attesting Officer*

BRUCE LEHMAN

*Commissioner of Patents and Trademarks*